US005358125A

United States Patent [19]

Blessing

[11] Patent Number: 5,358,125

[45] Date of Patent: Oct. 25, 1994

[54] SYSTEM FOR SUPPORTING BINDERS IN A HANGING FILE

[76] Inventor: Gary E. Blessing, 4853 Marydale Cir., Lilburn, Ga. 30247

[21] Appl. No.: 9,537

[22] Filed: Jan. 18, 1993

[51] Int. Cl.[5] ..... A47F 5/00

[52] U.S. Cl. ..... 211/46; 211/189

[58] Field of Search ..... 211/46, 189; 312/184; 248/188.9, 127, 300

[56] References Cited

U.S. PATENT DOCUMENTS

| | | | |
|---|---|---|---|
| 807,535 | 12/1905 | Beardsley et al. | 248/188.9 |
| 2,886,918 | 5/1959 | Bayley et al. | 248/188.9 |
| 3,357,669 | 12/1967 | D'Amato | 248/188.9 X |
| 3,742,552 | 7/1973 | Balchunas | 248/188.9 X |
| 3,801,175 | 4/1974 | Giulie | 312/184 |
| 3,936,201 | 2/1976 | Kenney et al. | 402/4 |
| 3,944,080 | 3/1976 | Hansen | 211/46 |
| 4,133,590 | 1/1979 | Young | 312/183 |
| 4,208,146 | 6/1980 | Schudy | 402/4 |
| 4,395,058 | 7/1983 | Terrell | 281/46 |
| 4,403,882 | 9/1983 | Fleck | 402/4 |
| 4,950,096 | 8/1990 | Gilder | 402/80 |
| 4,979,626 | 12/1990 | Pitts | 211/45 |
| 5,154,527 | 10/1992 | Blessing | 402/4 |

*Primary Examiner*—Alvin C. Chin-Shue
*Assistant Examiner*—Sarah L. Purol
*Attorney, Agent, or Firm*—Deveau, Colton & Marquis

[57] ABSTRACT

A hanging file system for supporting ring binders vertically in a file drawer, the system comprising a hanging file frame having laterally extending support rails, devices which are removably inserted into the ring binders for supporting the ring binders on the laterally extending support rails, and an apparatus for supporting and retaining the hanging file frame a selected distance above tile bottom of the file drawer. The apparatus for supporting the hanging file frame a selected distance above the bottom of the file drawer includes a plurality of support members, each being adapted to retain and support a separate corner of the hanging file frame. Each support member has a plurality of frame-receiving slots formed therein for receiving portions of the hanging file frame.

10 Claims, 4 Drawing Sheets

SYSTEM FOR SUPPORTING BINDERS IN A HANGING FILE

TECHNICAL FIELD

The present invention generally relates to ring binders and hanging files, and more particularly to a system for supporting ring binders in hanging files.

BACKGROUND OF THE INVENTION

One popular form of filing system in wide use today is the so-called "hanging file" in which two parallel support rails are positioned within a file drawer and extend laterally therein. File folders with hooks positioned at their upper outside ends are placed within the file drawer and hang (are suspended) by the hooks resting upon the support rails.

While this system has many advantages, it is not readily suitable for storing ring binders. Conventional ring binders have a book-like construction with a spine hingedly attached to front and back covers and a ring mechanism mounted to the spine by rivets or other fasteners. It is possible, during the manufacture of the ring binders, to make the ring binder capable of being suspended in the hanging file system by providing outwardly extending hooks for resting atop the lateral support rails of the hanging file system. However, this is inapplicable to the problem of placing existing, conventional ring binders in a hanging file. Furthermore, it is important that the ring binder, once removed from the hanging file, be capable of being quickly converted to its ordinary configuration in which it does not have hooks extending from the ends of the spine. This is so because such outwardly extending hooks tend to mar surfaces with which the hooks come in contact and in general the hooks tend to get in the way and look clumsy.

U.S. Pat. No. 3,936,201 of Kenney, et al. relates to a hanger for ring binders which is capable of being used with existing, conventional ring binders. The hanger disclosed therein has an elongate member with a length greater than the length of the spine of the ring binder, with hooks provided on the ends of the elongate member. The elongate member also has a number of slots to allow the member to be slipped over the rings of the ring binder. The slots have a length sufficient to allow the elongate member to slide along the length of the spine to allow the ring binder to stand on end without having the lowermost hook interfere with the supporting surface upon which the ring binder is standing. Such a device generally suffers however from requiring that to be used with existing ring binders already having material placed therein, the rings of the ring binder must be opened up to place the elongate member on the rings, thereby providing an opportunity for losing papers or replacing papers out of sequence.

U.S. Pat. No. 4,208,146 of Schudy relates to a suspension device for ring binders and discloses a device which is formed of an angled strip having slides which can be pulled out so as to project from opposite ends of the spine to suspend the binder. The device is adapted to fit on the rings of the ring mechanism of the binder and acts to support the rings for supporting the binder. Schudy also suffers from the same general shortcoming of devices according to Kenney, et al, namely that in order to mount and dismount the device of Schudy to a ring binder, one must open and close tile rings.

U.S. Pat. No. 5,154,527 of Blessing relates to a device for supporting ring binders in a hanging file which is capable of being mounted to existing conventional ring binders without requiring that the rings of the ring binder be opened. The devices are inserted between the spine of the ring binder and the ring mechanism at each end of the spine of the ring binder. The ring binder can then be placed in a hanging file with the medial portions of the devices resting atop the support rails of the hanging file.

When conventional ring binders are supported on a conventional hanging file frame by the devices according to U.S. Pat. No. 5,154,527, the ring binders sometimes can extend downwardly at a distance greater than the vertical distance between the lateral supports of the hanging file frame and the bottom of the file drawer. The result of this is that the ring binders can come in contact with the bottom of the file drawer. This contact between the ring binder and the bottom of the file drawer is undesirable. For example, this contact causes the ring binders to angle to one side in the file drawer. Also, the ring binder covers or the contents may become bent as a result of the contact. Furthermore, such an arrangement fails to maximize efficiency in the use of file drawer space.

Accordingly, it can be seen that a need yet remains for a hanging file system for supporting conventional ring binders in a conventional hanging file, while preventing the ring binder covers from being bent and promoting maximum efficiency in the use of file drawer space. It is to the provision of such that the present invention is primarily directed.

SUMMARY OF THE INVENTION

In a preferred form, the present invention comprises a hanging file system for supporting ring binders vertically within a file drawer. The system comprises a hanging file frame, a bracket or device for supporting ring binders on the hanging file frame, and a means for retaining and supporting the hanging file frame a selected distance above the bottom of a file drawer. The means for retaining and supporting includes a plurality of retainer-supporter devices, each of which retains and supports a separate portion of the hanging file frame. In a preferred form of the present invention, each of the retainer-supporter devices has a plurality of frame-receiving areas integrally formed therein for receiving and retaining the portions of the hanging file frame.

Preferably, the retainer-supporter devices are adapted to be removably connected to the hanging file frame to allow the frame to be conveniently seated upon the retainer-supporter devices. Therefore, the retainer-supporter devices can be conveniently removed altogether or replaced by other retainer-supporter devices of different dimensions to achieve the desired spacing between the bottom of the file drawer and the hanging file frame.

Accordingly, it is an object of the present invention to provide a hanging file system for supporting ring binders in a file drawer which is durable, economical in its manufacture, and effective in its use.

It is another object of the present invention to provide a hanging file system for supporting ring binders which facilitates the mounting and removal of ring binders without the necessity of opening the rings of the ring binder.

It is another object of the present invention to provide a hanging file system for supporting ring binders in a conventional file drawer, which system allows the use of ring binders of varying dimensions and file drawers of varying depths.

It is another object of the present invention to provide a hanging file system for supporting ring binders in a file drawer which prevents ring binder covers from being bent while stored in the hanging file system.

It is yet a further object of the present invention to provide a hanging file system for supporting ring binders which maximizes efficiency in the use of file drawer space.

Other objects, advantages, and features of the present invention will become apparent upon reading the following specification in conjunction with the accompanying drawing figures.

BRIEF DESCRIPTION OF THE DRAWING FIGURES

DETAILED DESCRIPTION

Figure 1:
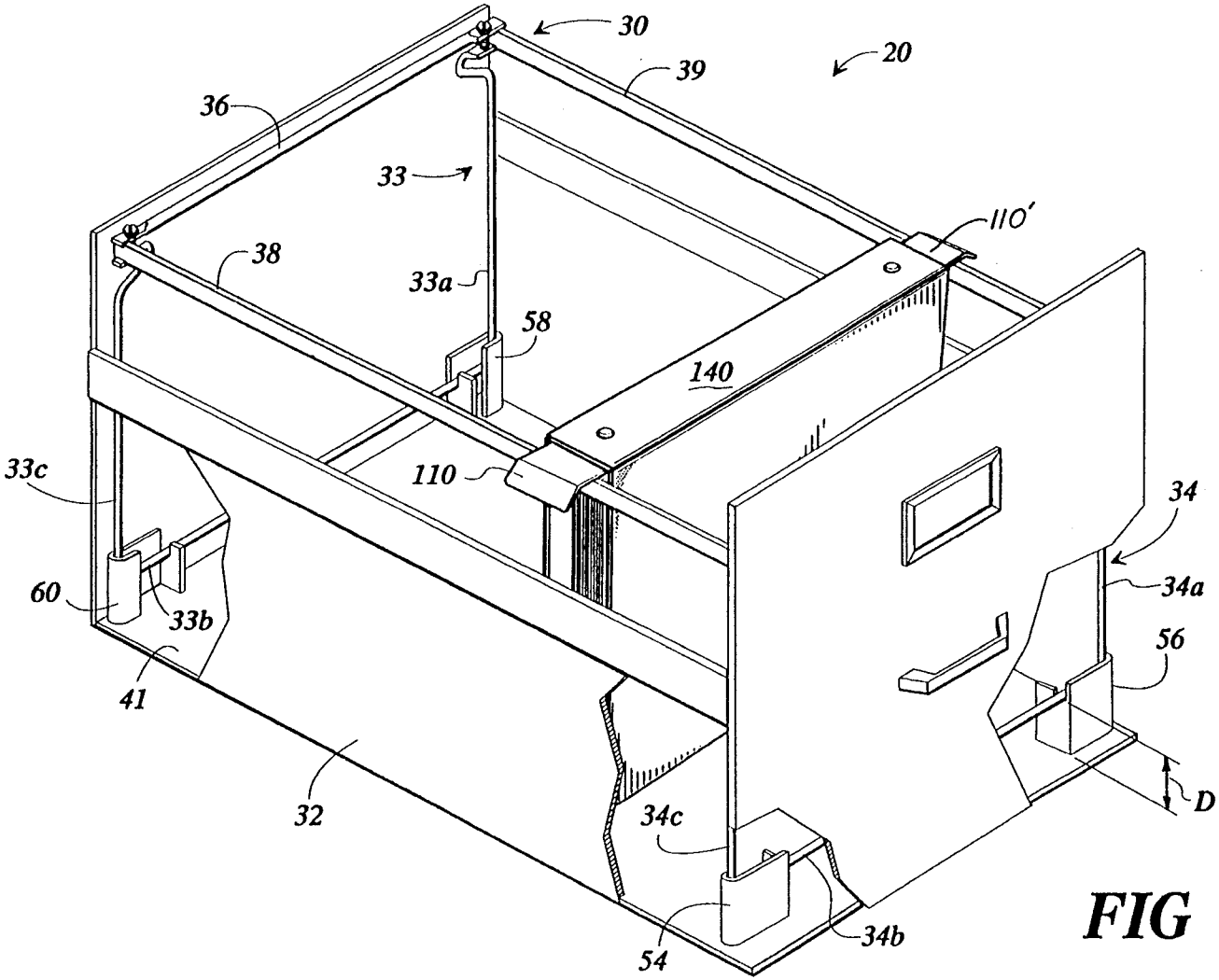
FIG. 1 is a perspective illustration of the hanging file system according to the present invention.

Referring now in detail to the drawing figures, in which like reference numbers depict like parts throughout the several views, FIG. 1 shows a hanging file system 20 according to a preferred form of the present invention. The system 20 includes a hanging file frame assembly 30, shown mounted within a file drawer 32. The hanging file frame assembly 30 comprises first and second generally U-shaped, upright frame members 33, 34, the upright frame members 33, 34 including vertical, horizontal, and vertical portions 33*a*, 33*b*, 33*c* and 34*a*, 34*b*, 34*c*, respectively. Transverse rails extend between the vertical portions 33*a*, 33*c* and 34*a*, 34*c* and are secured thereto by threaded fasteners. (In FIG. 1, transverse rail 36 can be seen, while a second transverse rail is obscured by the front face of the file drawer.) These relatively short transverse rails also act as clamps securing longer transverse rails 38, 39 which extend between the U-shaped upright frame members 33, 34. A pair of ring binder support devices 110, 110' support each ring binder 140 upon the long transverse rails 38, 39 of the hanging file frame 30.

The hanging file frame 30 is supported above the bottom 41 of the file drawer 32 by retainer-supporter devices 54, 56, 58, and 60. Each retainer-supporter device has two frame-receiving areas integrally formed therein for receiving horizontal and vertical portions of the hanging file frame. With reference to retainer-supporter 60 for example, it can be seen that one frame-receiving area receives and retains a horizontal portion 33*b*, whereas a second frame-receiving area receives both a vertical portion 33*c* and horizontal portion 33*b*. Vertical portion 33*c* and horizontal portion 33*b* are restrained from movement in the lateral and vertical (downward) directions. Each of the retainer-supporter devices retains and supports a separate corner of the hanging file frame 30 a selected distance, D, above the file drawer bottom 41. This arrangement allows the ring binder 140 to be supported by devices 110, 110' on lateral support rails 38, 39 a selected distance above the file drawer bottom 41.

Each of the retainer-supporter devices 54, 56, 58, and 60 are adapted to be removably connected to the lower corner portions of the hanging file frame. This facilitates removal or replacement of the retainer-supporter devices in a convenient manner. Hence, the hanging file frame 30 can be raised a selected distance, D, above the file drawer bottom 41 by simply providing the retainer-supporter devices of the appropriate height. The retainer-supporter devices are described in more detail below with reference to FIGS. 9–11.

Figure 4:
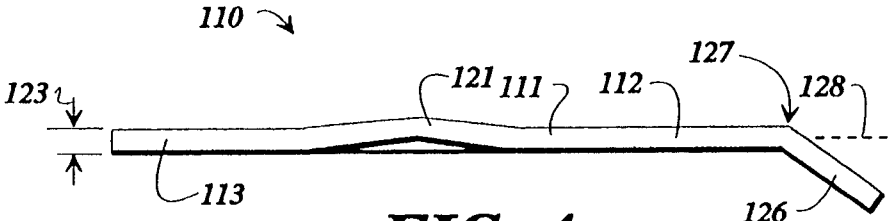
FIG. 4 is a side elevation view of the device of FIG. 2.
Figure 2:
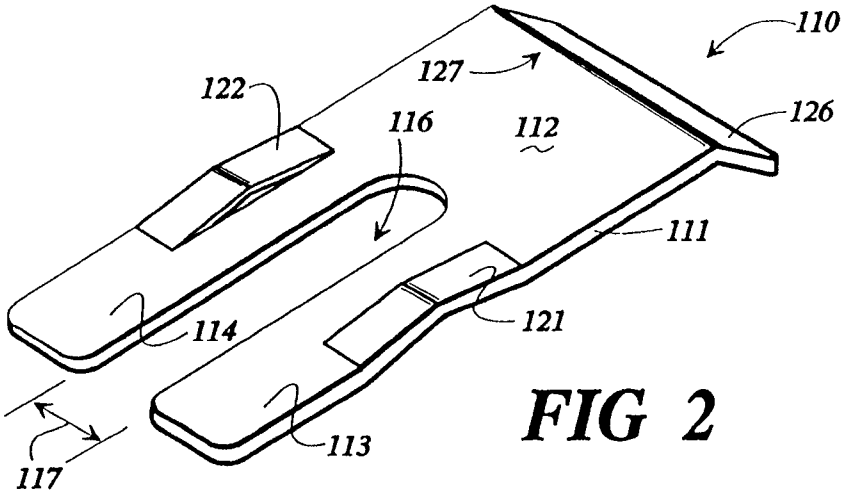
FIG. 2 is a perspective illustration of a portion of the system of FIG. 1, in particular a device for supporting a ring binder within a hanging file.
Figure 3:
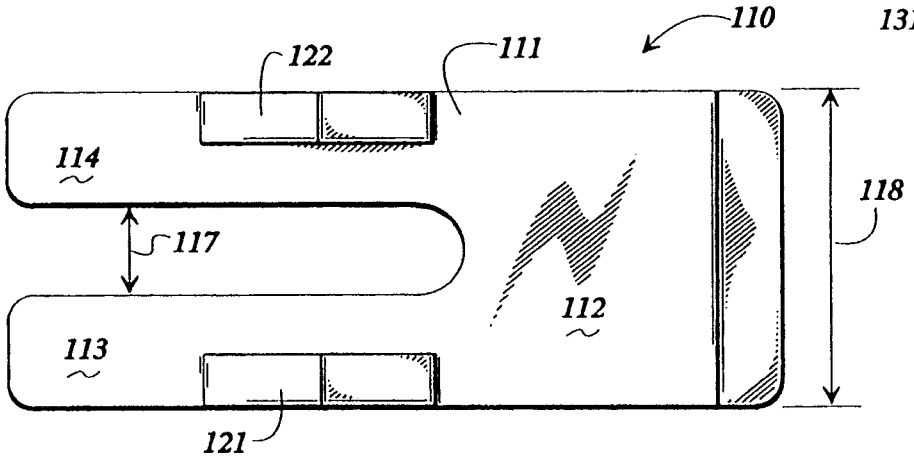
FIG. 3 is a plan view of the device of FIG. 2.

FIGS. 2–4 show the devices 110, 110' for supporting a ring binder vertically within a hanging file system (items 110 and 110' being identical to each other). The device 110 is particularly adapted for supporting such ring binders of the type having a spine and a ring mechanism secured to the spine by two or more fasteners. The device 110 then allows, with the use of two such devices, the ring binder to be supported upon lateral support rails of the vertical filing system.

Device 110 is in the form of a generally U-shaped support bracket 111 which is adapted to be removably inserted between the spine of the ring binder and the ring mechanism of the ring binder. The U-shaped support bracket 111 includes a medial portion 112 of rectangular shape and first and second elongate arms 113, 114 adjoining and extending from the medial portion 112. The medial portion 112 and the elongate arms 113, 114 are all in a common plane. The elongate arms 113, 114 are in parallel, spaced apart relationship to one another and define therebetween an elongate slot or opening 116. The elongate slot 116 has a width 117 designed to accept therein the size of rivets, bolts, etc., typically found securing the spine to the ring mechanism in conventional ring binders.

The U-shaped support bracket 111 is made from a stamped piece of bright metal, such as stainless steel or plain steel which is chrome plated subsequent to the stamping operation. The U-shaped support bracket 111 has a width 118 sized for allowing the device 110 to be slipped between the spine and the ring mechanism of the ring binder. Of course, one can make devices having a width small enough to fit within most standard size ring binders by making the width 118 smaller than the width of the typically smallest ring binder (1 inch). On the other hand, one can make different size devices 110 having different widths 118 corresponding to the size of the ring binder in which it is to be mounted (e.g., 1 inch, 1 ½ inches, 2 inches, 3 inches, etc.).

The elongate arms 113, 114 carry thereon raised projections 121, 122. The purpose of the raised projections is to hold the device 110 in place when inserted between the ring mechanism and the spine of a ring binder. As shown, the raised projections can be made to have a width which is less than the width of each of the elongate support arms (in the embodiment depicted in the drawing figures, the width of the projections is approximately ½ the width of each of the elongate support arms). As shown in FIG. 4, the height of the projections 121, 122 above the elongate support arms 113, 114 ordinarily need only be on the order of several times the thickness 123 of the U-shaped support bracket 111.

An end portion 126 of the U-shaped support bracket 111 extends from a distal edge 127 of medial portion 112 and is oriented transversely of the plane 128 in which the medial portion 112 and the elongate arms 113, 114 lie. As depicted in the figures, the end portion 126 is oriented at a 45° angle, although other angles would work suitably well. Furthermore, while the end portion is shown as being generally planar, other configurations might be employed. The effect of the positioning and orientation of the end portion 126 is to create a somewhat hook-like structure which is useful for retaining the device upon a support rail of a hanging file system, as will be described in more detail below.

Figure 5:
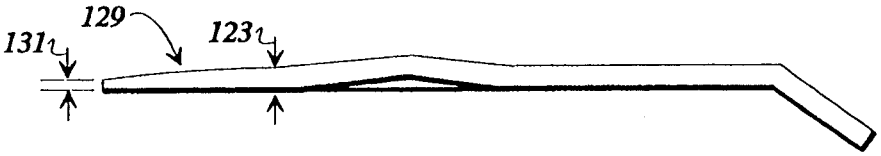
FIG. 5 is a side elevation view of a modified form of the device of FIG. 2.

FIG. 5 shows an alternative embodiment in which a leading end portion 129 of the elongate arms 113, 114 tapers from a thickness 123 generally adjacent the raised projections 121, 122 to a minimum thickness 131 at the tip of the elongate arms 113, 114. The taper of these elongate arms eases insertion of the elongate arms between the ring mechanism and the spine of the ring binder.

Figure 9:
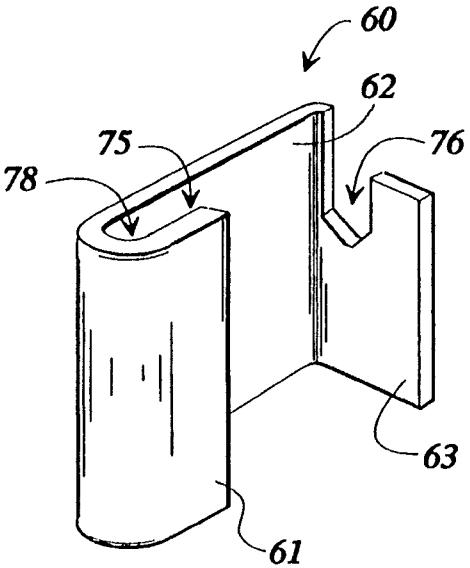
FIG. 9 is a perspective illustration of a retainer-supporter device portion of the system of FIG. 1.

FIG. 9 shows a detailed perspective view of a preferred form of the retainer-supporter devices of the present invention. Each retainer-supporter is typically formed from one piece of galvanized steel. However, it should be apparent to those skilled in the art that the retainer-supporters could also be formed from other materials suitable for use with the present invention. Devices 54 and 60 are mirror images of devices 56 and 58, with devices 56 and 60 being identical to each other and devices 54 and 58 being likewise identical to each other. For purposes of understanding the invention, consideration of one device is sufficient, namely device 60.

The retainer-supporter 60 has three sidewalls 61, 62, and 63 which are integrally connected to one another. Sidewall 63 defines a plane which is at a 90° angle to a plane defined by sidewall 62. Sidewall 61 is parallel to sidewall 62 and perpendicular to sidewall 63. Sidewall 61 is formed by bending a portion of sidewall 62 through an angle of 180° such that sidewall 61 and sidewall 62 are parallel to each other and form a slot or opening 75 therebetween including a half-cylindrical end 78. Sidewall 63, which extends from sidewall 62 and is perpendicular thereto, has a slot 76 formed therein. Sidewall 63 is formed by bending a portion of sidewall 62 through an angle of 90° such that sidewall 63 and sidewall 62 are perpendicular to each other. Alternatively, sidewall 63 may be made separately and welded to sidewall 62. This alternate means of forming a third sidewall is depicted in FIG. 11 where sidewall 169 is made separately and welded to sidewall 168.

Referring again to FIG. 9, slot 76 is generally U-shaped in nature and has vertical sides formed by sidewall 62 and 63 and a circular bottom portion formed in sidewall 63. The width of U-shaped slot 76 is aligned with and approximately equal to the width of the slot on opening 75 formed between sidewalls 61 and 62.

Figure 10:
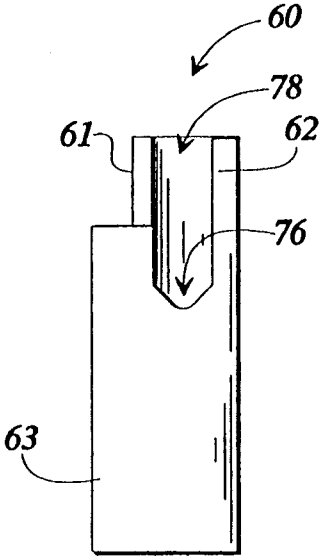
FIG. 10 is a side view of the retainer-supporter device of FIG. 9.

FIG. 10 shows a side view of retainer-supporter 60. It can be seen that U-shaped slot 76 is aligned with the opening on slot 75 formed between sidewalls 61 and 62. Opening on slot 75 and slot 76 correspond to the frame-receiving areas described above with reference to FIG. 1. The retainer-supporter 60 is adapted to receive a 90° elbow corner of the hanging file frame formed by vertical portion **33*c* and horizontal portion 33*b*. Slot 76 provides vertical support for horizontal portion 33*b* while restraining lateral movement of horizontal portion 33*b*. Frame-receiving area (slot 75 and end 78) restrains lateral movement of both horizontal portion 33*b* and vertical portion 33*c***.

Figure 11:
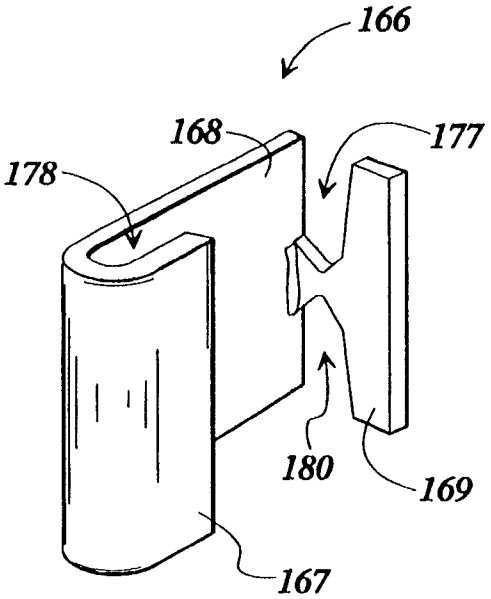
FIG. 11 is a perspective illustration of an alternative embodiment of the retainer-supporter device of FIG. 9.

FIG. 11 shows a second embodiment of the retainer-supporter devices of the present invention. Sidewall 67 and 68 are identical to sidewalls 61 and 62, respectively, of the device of FIG. 9. However, sidewall 69 differs significantly from sidewall 63 of the device of FIG. 9. As can be seen in FIG. 11, sidewall 69 has two U-shaped slots 77 and 80 formed therein. Slots 77 and 80 are geometrically opposed, mirror images of one another. Retainer-supporter 66 can be used to support and retain any corner of the hanging file frame 30 due to the fact that it can be implemented in an upright or inverted position, depending on which corner of the hanging file frame it is supporting. This allows one type of retainer-supporter to be mass-produced which is capable of retaining and supporting any corner of a hanging file frame in a hanging file system.

The base of retainer-supporter 60 shown in FIG. 9 is comprised of the bottom edges of sidewall 61, 62, and 63. Sidewall 63 of retainer-supporter 60 is somewhat shorter than sidewalls 61 and 62. This is because retainer-supporter 60 is only used in the upright position. Sidewall 69 of retainer-supporter 66, shown in FIG. 11, is the same height as sidewalls 67 and 68. This allows both the top edges and the bottom edges of sidewalls 67, 68, and 69 to function as the base for the retainer-supporter 66.

OPERATION

Use of the devices according to the present invention is quite simple and straight-forward. Retainer-supporters 54, 56, 58, and 60 are positioned on the bottom of file drawer 32 as indicated in FIG. 1. Then, the lower corner portions of hanging file frame 30 are mounted on retainer-supporters 54, 56, 58, and 60 at their respective frame-receiving areas, described above with reference to FIG. 1. Alternatively, retainer-supporters 54, 56, 58, and 60 may be mounted on the lower corner portions of hanging file frame 30 before placement of tile hanging file frame in file drawer 30.

Figure 7:
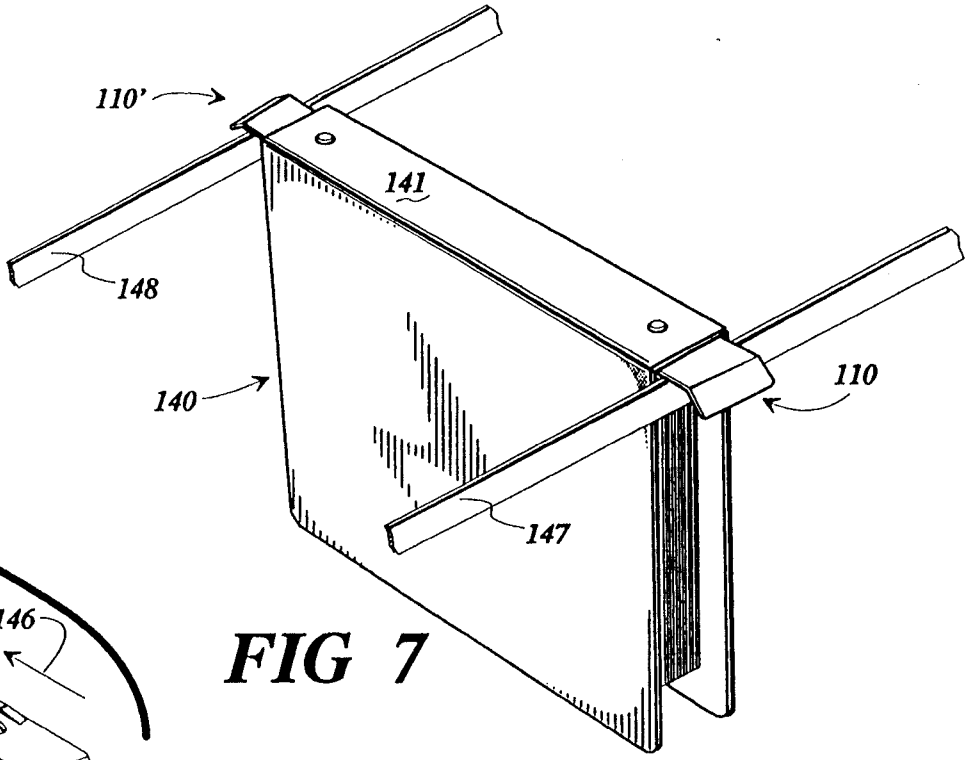
FIG. 7 is a perspective, schematic illustration of the devices of FIG. 6, shown mounted in a ring binder and supporting the ring binder upon support rails of a hanging file system.
Figure 8:
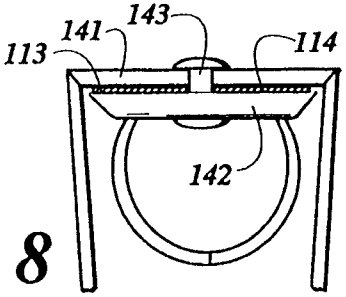
FIG. 8 is a side sectional view of one of the devices of FIG. 6, shown mounted in the ring binder.
Figure 6:
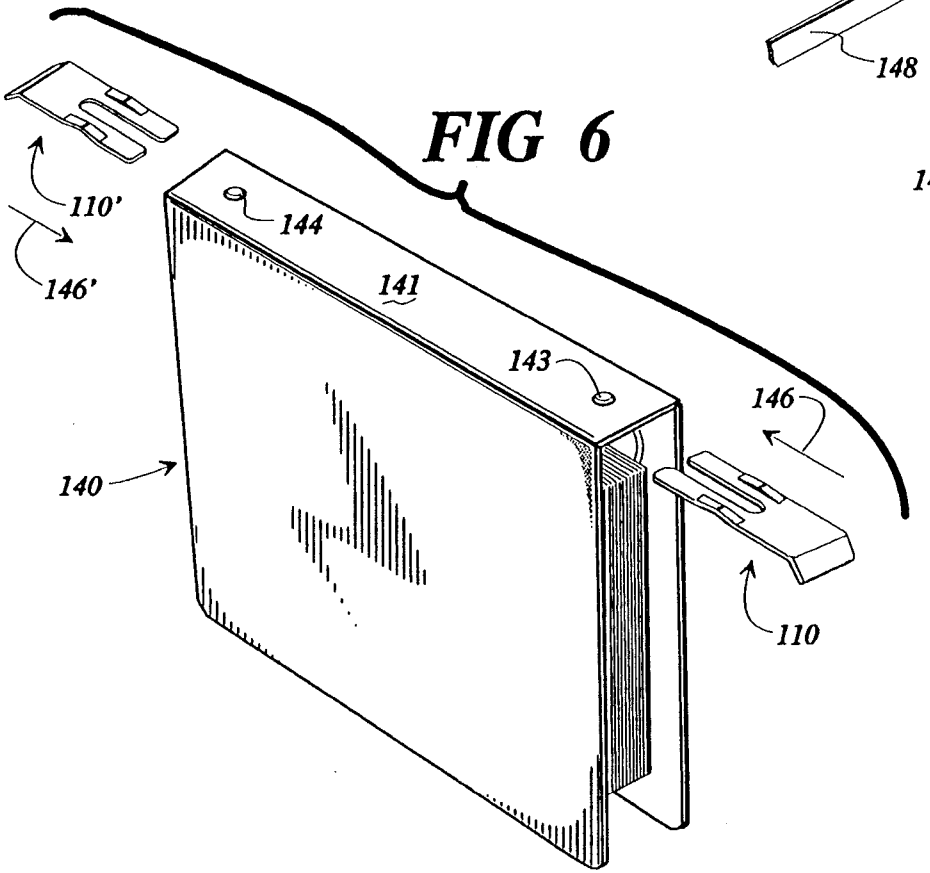
FIG. 6 is a schematic, partially exploded view showing how two of the devices of FIG. 2 are inserted into a ring binder.

Next, as depicted in FIG. 6, two devices 110, 110' are inserted between the spine 141 of a conventional ring binder 140 and the ring mechanism 142 (See FIG. 8). The ring mechanism 142 is secured to the spine 141 by rivets 143, 144. To mount the devices 110, 110' to the ring binder 140, one pushes the devices into the ring binder along directions 146, 146', respectively. The devices 110, 110' thus are eased between the ring mechanism 142 and the spine 141 until the configuration of FIG. 7 is achieved. With the devices 110, 110' now mounted to the ring binder 140, the ring binder can be placed in a hanging file by dropping it between the parallel, horizontal support rails 147, 148 of the hanging file system. As shown in FIG. 7, the horizontal support rails 147, 148 support the devices 110, 110', which devices in turn support the ring binder 140. This manner of supporting binders in a hanging file has the advantage of allowing the contents of the ring binder to hang from the rings without interference from any other structure, as well as allowing the front and back covers of the ring binder also to hang unimpeded.

To remove the devices 110, 110' from the ring binder 140, one simply grasps the end portions 126 of each of the devices and pulls outwardly, in the direction opposite to direction arrows 146, 146'. This withdraws the devices from between the spine of the ring binder and the ring mechanism of the ring binder. To prevent the devices from becoming accidentally or unintentionally removed or unmounted from the ring binder, the projections 121, 122 provide some gripping action when the devices are inserted between the spine and the ring mechanism. Since the space between the ring mechanism and the spine is quite limited, the raised projections tend to dig into the inside of the spine somewhat, thereby providing some limited amount of gripping force.

Therefore, the present invention provides a system for supporting ring binders in a file drawer which allows the ring binders to hang vertically within the file drawer without coming into contact with the bottom of the file drawer. This arrangement prevents the covers of the ring binders from being bent and facilitates the achievement of maximum efficiency in the use of file drawer space. The retainer-supporter devices provide a convenient means for retaining and supporting a hanging file frame a selected distance above the bottom of the file drawer. Furthermore, the retainer-supporters can be developed in various sizes to achieve a desired or minimum distance between the hanging file frame and the bottom of the file drawer.

While the invention has been described in preferred forms only, it will be obvious to those skilled in the art that many modifications, additions, and deletions may be made therein without departing from the spirit and scope of the invention as set forth in the following claims.

I claim:

1. Apparatus for supporting a hanging file frame in a drawer, the drawer having a plurality of sides and a bottom, said apparatus comprising a plurality of support members, each of said support members having at least one frame-receiving slot formed therein for receiving and retaining a horizontal section of the hanging file frame, said apparatus being adapted for supporting the hanging file frame a selected distance above the bottom of the drawer.

2. Apparatus according to claim 1 wherein the hanging file frame includes a plurality of vertical and horizontal sections, and wherein each of said plurality of support members has first and second slots formed therein, said first slot receiving and retaining a horizontal section and a vertical section of the hanging file frame, and said second slot receiving and retaining a horizontal section of the hanging file frame.

3. Apparatus according to claim 1 wherein said support members each have three slots formed therein for receiving sections of the hanging file frame therein.

4. A support device for supporting a hanging file frame in a drawer, the hanging file frame having a plurality of vertical and horizontal sections, said support device comprising:

first and second sidewalls connected to each other adjacent one end of each of said first and second sidewalls, said first and second sidewalls having portions extending parallel to each other and spaced apart, wherein a first frame-receiving area is formed in said support device adjacent where said first and second sidewalls are connected to each other; and a third sidewall connected to one of said first and second sidewalls, said third sidewall extending transverse to one of said first and second sidewalls and having at least a second frame-receiving area formed therein.

5. A support device according to claim 4 wherein said support device simultaneously retains and supports a vertical portion and a horizontal portion of the hanging file frame.

6. A support device according to claim 4 wherein said first frame-receiving area is configured to receive at least a vertical section of the hanging file frame.

7. A support device according to claim 4 wherein said second frame-receiving area is configured to receive a horizontal section of the hanging file frame.

8. A support device according to claim 4 wherein said third sidewall is shorter than said first and second sidewalls.

9. A support device according to claim 4 wherein said first frame-receiving area and said second frame-receiving area are substantially horizontally aligned such that a horizontal section of the hanging file frame can be received in both said second frame-receiving area and said first frame-receiving area.

10. A support device according to claim 4 wherein a third frame-receiving area is formed therein, said third frame-receiving area being formed in said third sidewall, and wherein said third frame-receiving area is a substantially mirror image of said second frame-receiving area, whereby said support device can be used in an upright or inverted position for retaining and supporting said hanging file frame.

* * * * *